US005103577A

United States Patent [19]

Michaels et al.

[11] Patent Number: 5,103,577

[45] Date of Patent: Apr. 14, 1992

[54] BODY HEATER/DRIER

[76] Inventors: Peter Michaels, 24-1711 Kingston Road, Scarborough, Ontario, Canada, M1N 1S8; Dennis Moore, 56 Valhalla Blvd., Scarborough, Ontario, Canada, M1N 3B4

[21] Appl. No.: 441,457

[22] Filed: Nov. 27, 1989

[30] Foreign Application Priority Data

Mar. 21, 1988 [CA] Canada ..... 561979

[51] Int. Cl.[5] ..... F26B 19/00

[52] U.S. Cl. ..... 34/91; 34/97; 34/98

[58] Field of Search ..... 34/90, 91, 97, 98; 219/373

[56] References Cited

U.S. PATENT DOCUMENTS

| | | | |
|---|---|---|---|
| 1,637,488 | 8/1927 | Knopp | 34/97 |
| 3,128,161 | 4/1964 | Hudon | 34/233 |
| 3,265,346 | 8/1964 | Petrick | 34/99 |
| 3,449,838 | 6/1969 | Chancellor, Jr. | 34/90 |
| 3,878,621 | 4/1975 | Duerre | 34/90 |
| 4,871,900 | 10/1989 | Hickman | 34/202 |

FOREIGN PATENT DOCUMENTS

| | | | |
|---|---|---|---|
| 903470 | 6/1972 | Canada . | |
| 20896 | 12/1891 | United Kingdom | 34/97 |
| 2140295 | 11/1984 | United Kingdom . | |

*Primary Examiner*—Henry A. Bennet
*Assistant Examiner*—Denise L. F. Gromada

[57] ABSTRACT

A common annoyance for many people is the sensed change in temperature after disrobing or upon exiting the bathtub or shower stall area. The body heater/drier utilizes a unique means by which it disperses warm air to the many areas of the user. Air is drawn into the base assembly of the apparatus, heated and forced to flow into the tubing sections connected in series above. The air within increases in pressure since the total volumetric flow of air induced within the apparatus is greater than total volumetric flow of air which is possible through the limited total cumulative area of all the output openings. The resultant pressure causes the air to flow out of the apparatus in various directions and in varying volumes directly dependent upon the particular inclination in size and shape of each various output opening through which air flows. The output openings act jets to control air dispersal. The body heater/drier is designed to be space efficient, light-weight, self-supporting, easily assembled or disassembled, and easily transportable by most any adult person without need for assistance or tools. This design enables the apparatus to utilize the equivalent heating element and fan/blower assembly power as that of a common hand held hair dryer.

6 Claims, 6 Drawing Sheets

BODY HEATER/DRIER

BACKGROUND OF INVENTION

Although heaters exist for general area warming or even hand-held varieties to dry hair, there has not been a simple device which could not only warm the many areas along the entire length of the human body but be portable, light-weight, free-standing, self-supporting as well as space and cost efficient. Our present invention does in all ways address these needs. The body heater/-drier in fact utilizes the equivalent heating element and fan/blower assembly motor power of a common hand-held hair dryer to accomplish this. Our present invention utilizes the principle of a closed pressure system and carburetion style jetting to facilitate air delivery as well as air dispersal control. In so doing, the body heater/drier is able to be small enough for varied placement, easily assembled or disassembled, self-supporting and is easily transportable by any adult person without the need for assistance or tools.

Some devices were developed to attempt complete drying of the human body, however in all cases these devices are much larger and designed to be affixed by installation in or around bathroom areas and were also intended to replace the need for towels and or for generally commercial purposes. Allowing that they may serve a function for the average consumer, these devices are much more costly and bulky units requiring permanent installation most often into the walls or ceilings of bathrooms. These devices require more powerful blowers and high volumetric capability. These devices are notably different in a number of areas, but none greater than the very means by which they deliver their air flows.

SUMMARY OF INVENTION

Our invention is markedly different in a number of ways.

Firstly, the body heater/drier is designed primarily as a warming device for the human body and in so doing, assists in its drying, where as other devices are primarily designed to facilitate the complete drying of the anatomy.

Secondly, is the means by which air is delivered. Our invention internally induces a total volumetric flow of air which is greater than the total volumetric flow of air which is possible through the total number of output openings. As a result, the air within the apparatus increases in pressure while some air is permitted to escape or bleed out of the numerous output openings acting as jets. The resultant increase in pressure forces the air out through the various output openings and this air travels in a variety of directions and in varying volumes directly related to and inclined by the various shapes and various sizes of the output openings through which this air travels. In essence, the limitation of the total cumulative area of all the various output openings serves to enable the various output openings to act as restrictive openings and to in effect act as jets.

The other devices deliver air unimpeded by means of larger and more powerful blowers and require louvers or deflectors to direct air flow. Our device utilizes the nominal air flow delivery of a common hand-held hair dryer and capitalizes upon the pressure build-up within the apparatus to force the air through variously sized and variously shaped output openings to utilize the restrictive nature of the output openings to control the air flowing through them.

Thirdly, once the tubing sections are assembled in series above the base assembly, it forms an upright assembly, enabling the body heater/drier to be free-standing and self-supporting and thus can be placed in more confined or limited area of space as is most often the circumstance found in most bathroom areas. Other devices are much larger requiring much more room as well as more permanent installation and support, thus limiting a user's choice or even the possibility of any varied placement.

Fourthly, our present invention comprises tubing sections having interference fits so as to make our apparatus easily assembled or disassembled by most any adult person for the purposes of mobility and therefore our invention is easily transportable.

Fifthly, our invention in utilizing our novel means of air delivery, is substantially smaller and light-weight when compared to other devices. The smallness of size and low mass enables most any adult person the capability to lift and carry the apparatus with just a reasonable effort.

Finally, in addition to the unique utility of providing warmth more directly to the many areas of the human body, our invention has the added utility of warming and assisting in the drying of various other lengthy objects at their place of rest such as hanging drapes or painted walls since our invention is mobile and can be re-located to most any preferred position in the home or elsewhere by most any adult person without the need for assistance or tools.

DESCRIPTION OF THE PREFERRED EMBODIMENTS OF THE INVENTION

Our invention as shown in the various drawings is a free-standing and self-supporting apparatus, utilizing the principle of jetting and closed-system pressure to control and disperse the air orginating from the fan/-blower assembly within the base assembly. Once activated by switches at the lower area of the base housing, air is forced up through the interfaced primary tubing sections that are assembled in series above and with the base assembly, and this air is forced out through a plurality of variously sized and variously shaped output openings acting as jets that are located along the exterior of and also permeating the enclosure means of the primary tubing sections along the entire length of the apparatus.

Figure 1:
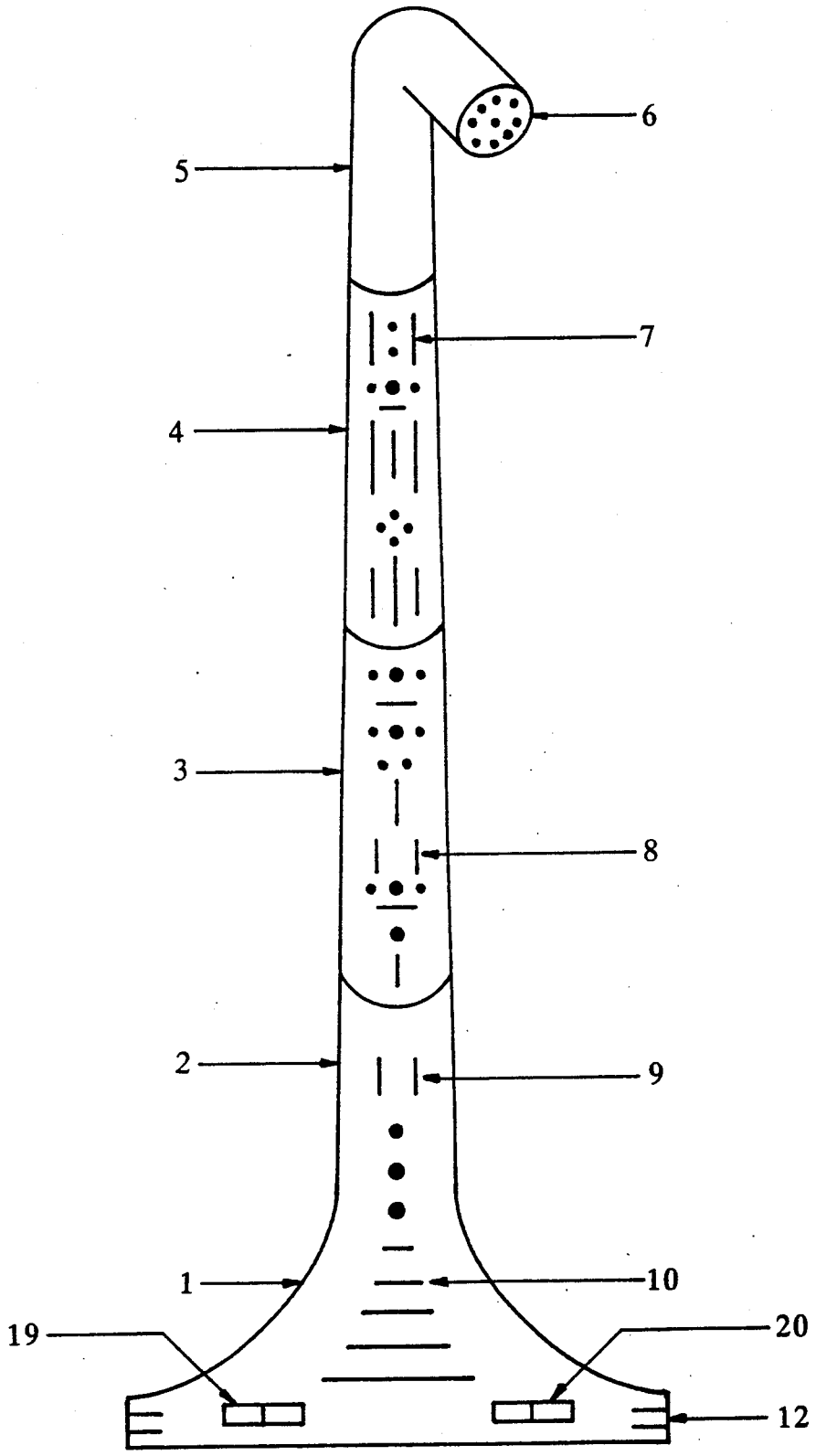
FIG. 1 shows one style of a complete basic apparatus without optional features.
Figure 2:
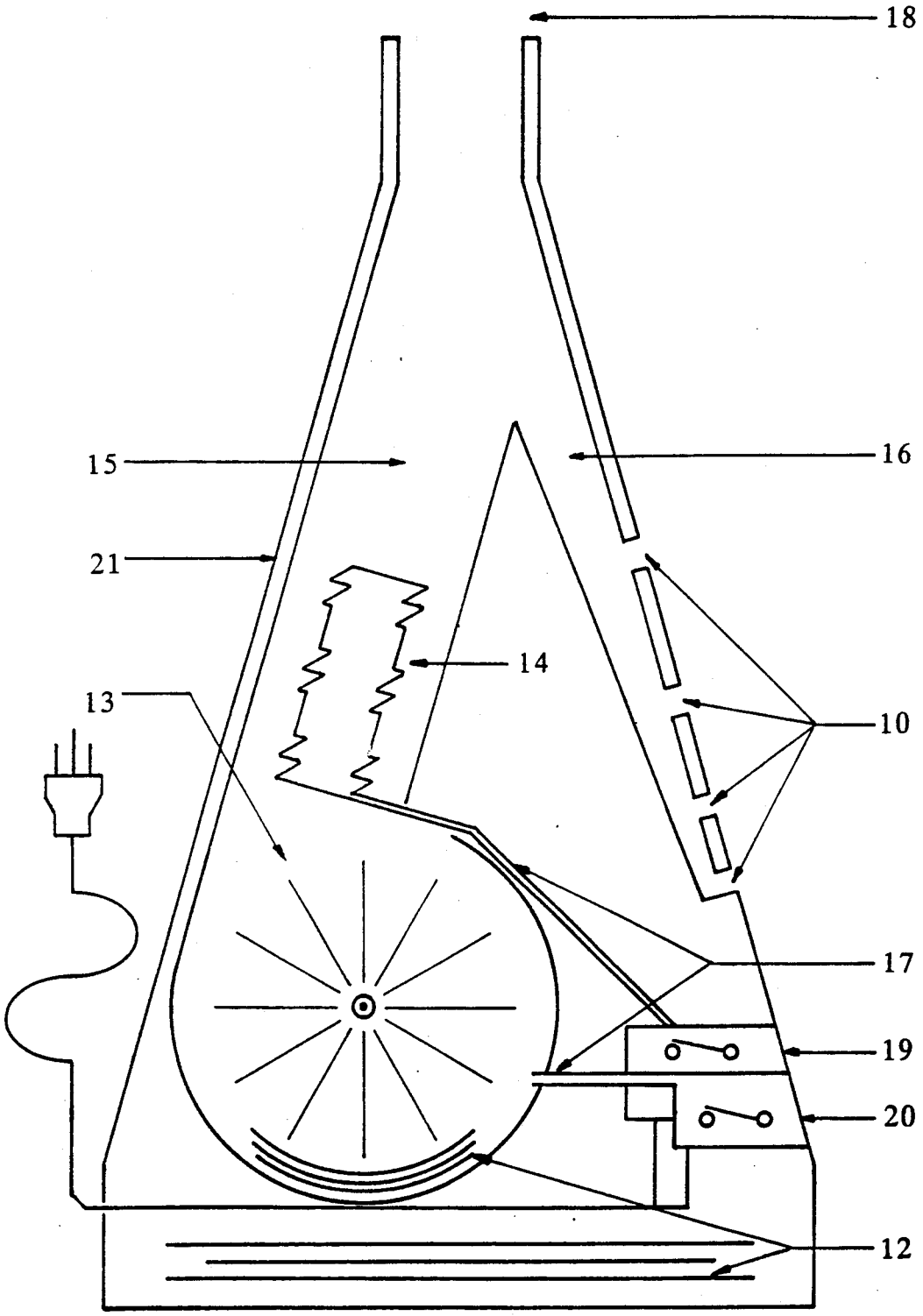
FIG. 2 shows a side internal view of the base assembly and the sub-housing within the base assembly.

Within the base housing as shown in FIG. 2, we see an internal side view. This base housing and sub-housing as well as the remainder of the apparatus housing and shell, should be made from pre-molded plastic, capable of acceptable heat tolerance. The pre-molded base housing as shown as Item 21 in FIG. 2, (also shown as Item 1 in FIG. 1), includes within it, a close tolerance fit sub-housing within which is located the electric fan/-blower motor assembly, Item 13, which together with the sub-housing is notably raised within the base housing, above the air inlet openings shown as Item 12. This placement is intended to be an added safety feature in the event of excess water spillage in the surrounding floor area.

The sub-housing shown as Item 15 includes a primary air pathway that emanates upwards from the electric fan/blower assembly to the tubing section receptacle shown as Item 18 in FIG. 2 (also as Item 2 in FIG. 1), located at the top of the base housing. Within the same primary air pathway in the sub-housing Item 15, an electric heating element noted as Item 14, is located between the fan/blower assembly noted as Item 13, and the top of the base housing. Electric wiring noted as Item 17, safely and operationally connects the electric heating element noted as Item 14, from the secondary electric switch noted as Item 19, and the electric wiring safely and operationally connects the electric fan/-blower assembly noted as Item 13, to the primary electric switch noted as Item 20.

Along the opposite side across from the primary air pathway Item 15, is a secondary air pathway Item 16 which emanates upwards to join the primary pathway both becoming one shared space under Item 18 noted as the tubing section receptacle at the top of the base housing. Permeating the base housing in the area above both switches noted as Items 19 and 20, are a number of various output openings noted as Item 10, which gain access to the secondary air pathway Item 16 so as to provide air dispersal to a user's feet.

The primary and secondary electric switches, Items 19 and 20, are notably located nearing, but safely above the floor once the base assembly is at rest, for easy activation of the switches by the feet. These switches are intended to be large and easily activated with any reasonable effort. The area of the base housing below said switches, contains air inlet openings noted as Item 12, which not only allow entry of air to be drawn in by the fan/blower assembly, but provides a safety release area for moisture to escape.

The tubing section receptacle noted as Item 18, FIG. 2 (also noted as Item 2 in FIG. 1), is of an appropriate size to enable the connection of a primary tubing section. As shown in FIG. 5, each primary tubing section includes one primary end having a larger internal diameter shown here as Item 29, and includes one secondary end having a smaller external diameter shown here as Item 28. Each primary tubing section as shown by a side cut-away view noted as Item 30 of FIG. 5 (and also shown as Items 3, 4, and 5 in FIG. 1), is enabled of connection with alternate primary tubing sections, and or the tubing section receptacle of the base housing shown as Item 18, FIG. 2, and or the curved top tubing section shown in FIG. 4. Thus, by utilizing interference fits, the actual assembly or disassembly of the apparatus can be performed easily and results in a reasonably air tight fit.

Figure 3:
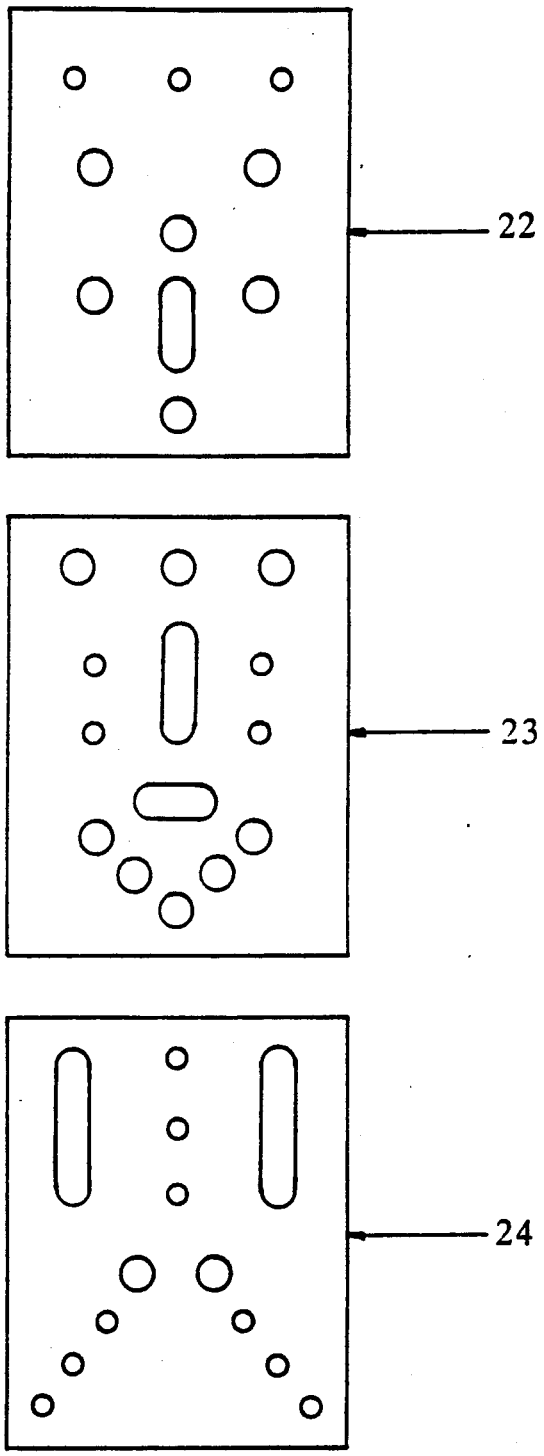
FIG. 3 shows the surface view of three primary tubing section samples and the possible variations of the output openings acting as jets, and some output opening configurations.
Figure 4:
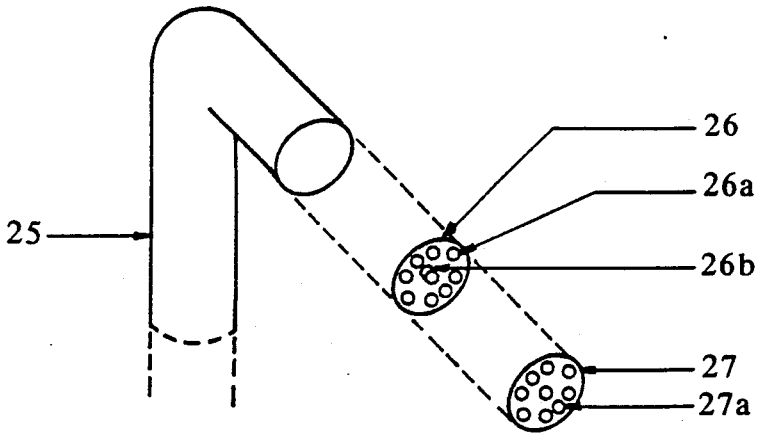
FIG. 4 shows the curved top tubing section including the air dispersal control device.
Figure 5:
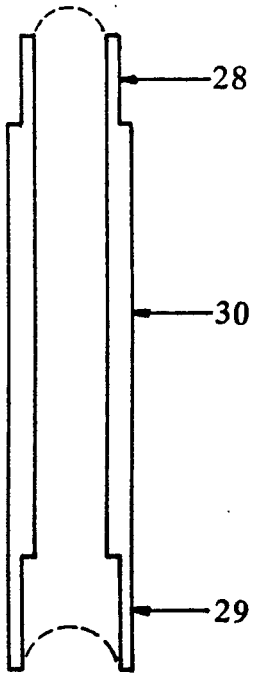
FIG. 5 shows a side cut-away view of a primary tubing section including a primary end comprising a larger internal diameter and a secondary end comprising a smaller external diameter, both ends intended to interface with opposite ends of alternate primary tubing sections in an air tight means.

Assembly of the curved top tubing section of FIG. 4 with the series of primary tubing sections Item 3, Item 4, and the tubing section receptacle, Item 18, completes the assembly of this apparatus. Note in FIG. 3, that variously shaped and variously sized output opening configurations will be used to achieve varied results and improved upon in time. Items 22, 23, and 24 of FIG. 3, and Items 7, 8, and 9 of FIG. 1, show samples of various output opening configurations for the face, mid torso, and leg areas.

Figure 6:
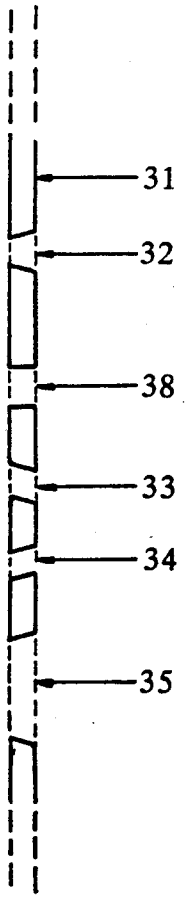
FIG. 6 shows a side cut-away view of various types of output openings to achieve varying air dispersal results.

Shown in FIG. 6 is a side cut-away view of an assortment of various output opening styles to be used in the various primary tubing sections. Item 31 is a typical primary tubing section enclosure means or wall. Item 32 shows an outwardly tapered output opening. Item 33 and Item 34, show straight and circular output openings which angle downward and upward respectively. Item 35 shows an elongated or slotted, as well as tapered output opening. Item 38 shows a straight and circular output opening style to be varied by internal size for varied air delivery.

Figure 7:
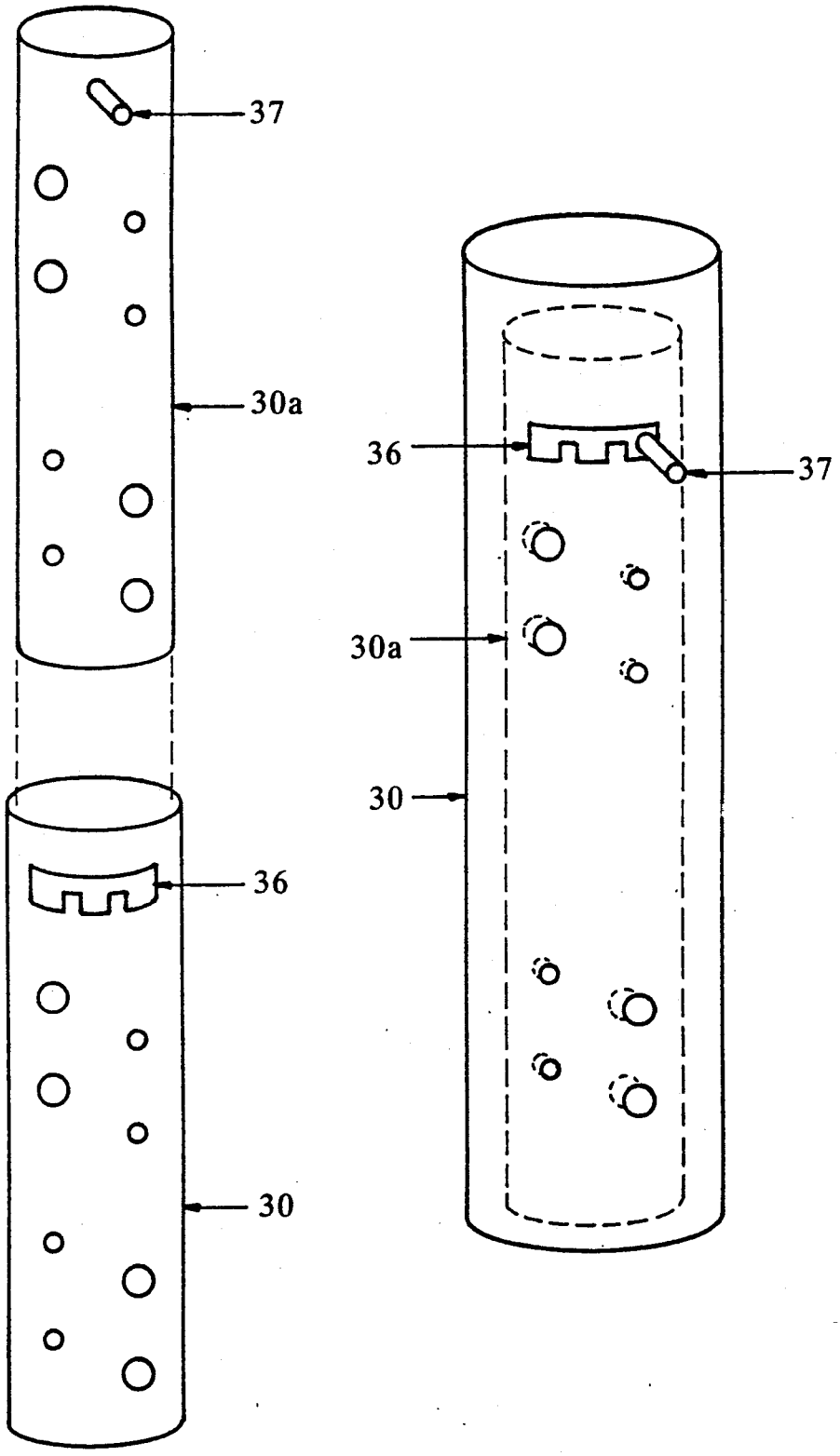
FIG. 7 shows an optional primary tubing section style, with an internal secondary tubing section having an affixed handle which protruding through the elongated opening in the primary tubing section, enables the user to vary or eliminate sectional air dispersal by rotation of the secondary tubing section. Note that both primary and secondary tubing sections possess matching configurations of output openings in direct alignment. Movement of the secondary tubing section varies the alignment of the configurations and thus varies the flow of air through the output openings of the primary tubing section.

An optional feature will be the insertion of a secondary tubing section shown as FIG. 7 having a smaller external diameter than the internal diameter of a primary tubing section, into each primary tubing section.

The secondary tubing section, Item **30*a*, will fit closely within the primary tubing section, Item 30 and be enabled of rotation within Item 30. The primary tubing section will have an elongated slot, Item 36. Item 37, a handle, will be screwed into a threaded hole located strategically in Item 30*a***, so that the handle can protrude through the elongated slot to enable a user to move the secondary tubing section within the primary tubing section. The secondary tubing section will contain the same configuration and positioning of various output openings to enable alignment of the various output opening configurations to enable the user to vary or eliminate air dispersal through any particular primary tubing section by varying the alignment of both configurations. Naturally, the secondary tubing section will be of a length which just exceeds the length of the area of the configuration of the various output openings so as to not cause interference with primary and secondary ends during their assembly with alternate ends.

At the top of the assembled primary tubing sections, is the curved top tubing section noted as Item 5 of FIG. 1 and the more detailed view being the diagram shown in FIG. 4. This curved top tubing section comprises an air dispersal controlling device shown as Item 6 of FIG.

1, and in detail as shown in FIG. 4, comprises Items 26, 26a, 26b, 27, and 27a. This top tubing section Item 25, curves and changes in direction from 270 to 360 degrees, so as to focus or concentrate the dispersal of air passing through the output openings of this top tubing section and air dispersal controlling device, to the head and or upper body area of the user.

The air dispersal controlling device comprises two round discs located at the end of the curved top tubing section, Item 25. The outer disc, Item 27, is stationary and contains a circular pattern of output openings, noted as Item 27a, surrounding a central hole. An inner disc, Item 26, which is of equal size and comprises the same pattern of output openings noted as Item 26a, and matching Item 27a, is located closely against the rear of the outer disc, Item 27, and is enabled of rotation within a grooved slot located within the tubing wall or enclosure means, nearing the end of the curved top tubing section. At the centre of the inner disc, is Item 26b, which is a round handle capable of protruding through and rotating freely within the central hole of the outer disc, Item 27.

Therefore, activation of the electric fan/blower assembly Item 13, and the electric heating element, Item 14, via electrical switches noted as Item 20 and Item 19, induces the development of air flow past the heating element, causing the air to heat up as it passes by under pressure of inducement. The warm air flow travels into the tubing sections, Items 3 and 4. The total volume of air induced within the apparatus is greater than the total volumetric flow of air possible through the total cumulative area of all various output openings. As a result, air pressure increases within the apparatus forcing air to flow through all of the various output openings. The volume of air and direction of air flow exiting the apparatus through each output opening is directly dependent upon the size and shape of each particular output opening. As a result, each output opening becomes restrictive to the air flow forced through it thus enabling it to act as a jet in the control and dispersal of air flow through itself.

The curved top tubing section provides air dispersal to the head. An apparatus which utilizes the optional secondary tubing sections that are placed within the primary tubing sections has the added feature of being able to individually rotate the secondary tubing section of any particular primary tubing section to further control and direct air flow at the user's discretion. Therefore, a man shaving, or a woman applying makeup at the bathroom sink for example, can direct jetted air flow upon themselves in numerous ways and in varying intensities by limiting air flow through selected primary tubing sections, as they continue their personal hygiene activity or act of dressing.

Figure 8:
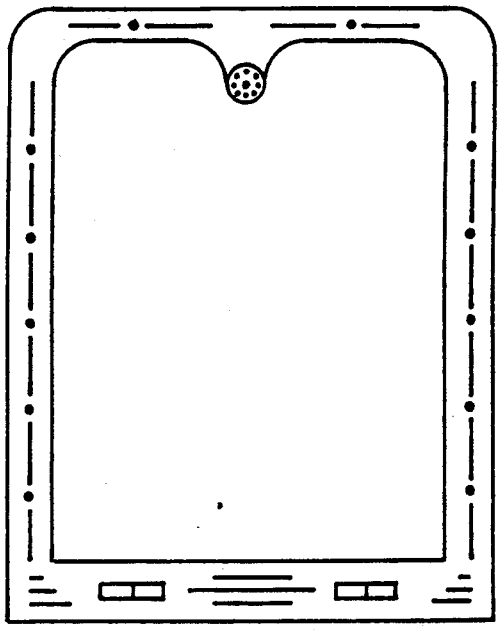
FIG. 8 and FIG. 8*a* shows design variations highlighting possible dimensional delivery variations such as "wrap-around" or "arch" styles, or variations of tubing style air delivery to accomplish more complete exposure to the various areas of the user at the same time, while the user maintains a more stagnant or more motionless stance.
Figure 8A:
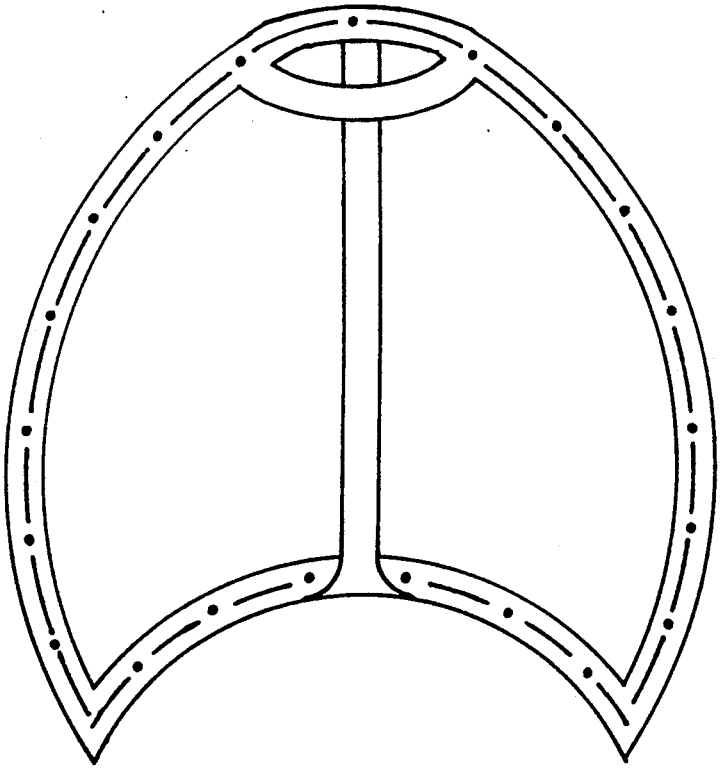

The fundamentals of the apparatus have been thus disclosed in this specification. Style variations have been and are continually being developed. Perhaps a most likely improvement, or optional style will centre around the maximum utility and variation of tubing section configurations, especially in a two or three sided model that provides a more dimensional proximity to the user. The optional style incorporated in an "arch" structure is shown in FIG. 8. Notice that the tubing is erected as if to run along the inner parameters of a doorway. Air delivery would in large part be "two-sided". The other style shown in FIG. 8a, shows a "three-sided" version, again to provide a more variably dimensional air delivery. Naturally, these designs will have varied base structure and style, and will utilize stronger and larger blower and heating unit elements. Such improved designs will provide greater application for use if required at health clubs, sports and recreational facilities, and hotels.

It should be noted however that the main impetus for the very development of this invention was its application for domestic use, and the utilization of the many advantages apparent from its design.

The embodiments of the invention in which an exclusive property or privilege is claimed are defined as follows:

1. A body warming apparatus comprising:

a) a base housing comprising:

i) an enclosure means;

ii) a sub-housing comprising a primary pathway and a secondary pathway, said sub-housing located within said base housing;

iii) an electric heating element means located within said primary pathway of said sub-housing;

iv) an electric fan/blower and motor assembly means located within said sub-housing;

v) a plurality of air inlet openings permeating said enclosure means of said base housing and said sub-housing, said air inlet openings enabling the flow of air into said base housing and said sub-housing;

vi) a tubing section receptacle located at the top of said base housing, said tubing section receptacle comprising an opening to access said primary and secondary pathways, and to enable air to flow out of said sub-housing;

vii) a primary electric switch means mounted at the surface of said base housing;

viii) a secondary electric switch means mounted at the surface of said base housing;

ix) a primary electric wiring means connecting said blower fan and motor assembly means to said primary electric switch means;

x) a secondary electric wiring means connecting said electric heating element means to said secondary electric switch means;

xi) an input electric wiring and plug means connected to said primary electric switch means and to said secondary electric switch means;

xii) a plurality of various output openings permeating the base housing enclosure means, said plurality of various output openings located above said primary electric switch means and above said secondary electric switch means.

b) a number of straight primary tubing sections connected in series to the top of said tubing section receptacle of said base housing, each primary tubing section comprising an enclosed hollow conduit, said enclosed hollow conduit comprising:

i) a primary conduit enclosure means;

ii) a primary end comprising an internal diameter;

iii) a secondary end comprising a smaller external diameter than said internal diameter of the primary end to enable said secondary end to be inserted into an alternate primary tubing section at the primary end of said alternate primary tubing section, said insertion and connection resulting in an air tight fit;

iv) a plurality of various primary output openings permeating the primary conduit enclosure means of said enclosed hollow conduit, said various primary output openings enabling the flow of air to flow from the interior to the exterior of said enclosed hollow conduit, said air flowing through said plurality of various primary openings;

v) the plurality of various primary output openings comprising various shapes and various sizes that vary the volumes and directions of the flows of air flowing from the interior to the exterior of a said primary tubing section through said plurality of various primary output openings;

vi) the plurality of various primary output openings comprising a total cumulative area which is limited to an amount less than the total area of output openings required to enable the total unrestricted volumetric flow of air through said plurality of various output openings, said limitation of the total cumulative area of the plurality of various output openings restricting the total volumetric flow of air flowing from within said enclosed hollow conduit to the exterior of said enclosed hollow conduit and resulting in an increase of air pressure within said enclosed hollow conduit;

vii) the plurality of various primary output openings functioning as a plurality of various jets to restrict and control, the volume and direction of air flow through said various primary output openings, said direction and volume of air flow directly influenced and inclined by the size and shape of each of said primary output opening;

c) a curved top tubing section comprising:

i) a curved and enclosed hollow conduit comprising a curved enclosure means;

ii) one primary end being of a size to enable assembly with a said primary tubing section in an air tight fit;

iii) one secondary end;

iv) a slot located on the interior surface of said curved enclosure means at said secondary end;

v) an air dispersal controlling device at said secondary end comprising: one outer stationary round disc affixed to said curved enclosure means and enclosing said secondary end, said outer stationary round disc comprising a hole at the center of said outer disc and a plurality of various output openings surrounding said hole, said various output openings permeating the remainder of said outer stationary round disc; and one inner round disc comprising a plurality of various output openings permeating said inner round disc, said plurality of various output openings of said inner round disc arranged and positioned in an identical configuration as said plurality of various output openings of said outer stationary round disc to enable alignment of the various output openings of said inner round disc with said various output openings of said outer stationary round disc once said air dispersal controlling device is assembled, said inner round disc located within said slot and adjacent said outer stationary round disc, said inner round disc also having a handle affixed to its center, said handle freely protruding through said hole of said outer stationary round disc once assembled, said handle enabling a user to manually rotate said inner round disc within said slot to vary the alignment of said configurations of various output openings of both said discs, said rotation of said inner round disc enabling a user to vary the volume of air flow through said air dispersal controlling device;

vi) the plurality of various output openings of said outer stationary round disc of said air dispersal controlling device comprising a total cumulative area which is less than the total area required to enable the total unrestricted volumetric flow of air flowing out of said curved top tubing section, said limitation of the total cumulative area of the plurality of various output openings causing air pressure to increase within said curved top tubing section;

vii) the plurality of various output openings of said outer stationary round disc functioning as a plurality of various jets to restrict and control the volume and direction of air flow through said various output openings, said direction and volume of air flow directly influenced and inclined by the size and shape of each said output opening;

2. A body warming apparatus as described in claim 1, said apparatus being self-supporting and without the need to be affixed.

3. A body warming apparatus as described in claim 1, said appartus being of a light weight to enable most any adult person the capability of transporting said apparatus without need for assistance.

4. A body warming apparatus as described in claim 1, said apparatus comprising a base housing, primary tubing sections, and a curved top tubing section, all aforementioned components being easily assembled or disassembled by most any adult person without the need for assistance or tools.

5. A body warming apparatus as described in claim 1, said apparatus once activated by the introduction of electricity to the electric fan/blower and motor assembly means as well as the introduction of electricity to the heating element means, said activation results in the inducement, heating and the delivery of air flow through said tubing section receptacle, said flow of air continuing to flow through the assembled said primary tubing sections, and said flow of air continuing to flow through said curved top tubing section, and said flow of air flowing out of said apparatus by flowing through all various output openings, and said flow of air being restricted by the limitation of the total cumulative area of the various output openings, and said air flow increasing in pressure within said apparatus, said increase in pressure thus forcing said air flow out of said apparatus, said air flowing through all the various output openings, the inclination of direction and the volume of said flow of air directly influenced by the size and shape of each various output opening, each various output opening functioning as a jet.

6. A body warming apparatus as described in claim 5, said apparatus additionally comprising:

a) an elongated opening permeating the primary enclosure means of each primary tubing section, said elongated opening comprising a series of indentations at the perimeter of said elongated opening;

b) a number of straight secondary tubing sections each of which is located within each primary tubing section, each secondary tubing section comprising an enclosed hollow conduit comprising:

i) a secondary enclosure means having an external diameter less than the internal diameter of a said primary tubing section;

ii) a plurality of various secondary output openings permeating the secondary conduit enclosure means of said enclosed hollow conduit, said various secondary output openings enabling the flow of air to flow from within to the exterior of said enclosed conduit, said air flowing through said plurality of various secondary output openings;

iii) a plurality of various secondary output openings arranged and positioned in an identical configuration as said plurality of various output openings of said primary tubing section, said identical configuration to enable alignment of the various output openings of the secondary tubing section with the various output openings of said primary tubing section, once said secondary tubing section is assembled within said primary tubing section;

iv) a handle affixed to said secondary tubing section, said handle located at a position to enable protrusion through said elongated opening of said primary tubing section once said secondary tubing section is assembled within said primary tubing section, said handle enabling a user to move and thus rotate said secondary tubing section within said primary tubing section, said rotation enabling the variation of alignment of the various output openings of the secondary tubing section with the various output openings of the primary tubing section, said variation of alignment enabling the variation of the volume of air flow from within said enclosed hollow conduit through the various output openings of the primary tubing section.

* * * * *